United States Patent [19]

Craft et al.

[11] Patent Number: 4,772,143

[45] Date of Patent: Sep. 20, 1988

[54] RELOADABLE RIBBON CARTRIDGE

[75] Inventors: James A. Craft; James J. Molloy, both of Lexington, Ky.

[73] Assignee: International Business Machines Corporation, Armonk, N.Y.

[21] Appl. No.: 114,816

[22] Filed: Oct. 29, 1987

[51] Int. Cl.[4] ..... B41J 32/00

[52] U.S. Cl. ..... 400/208; 400/236

[58] Field of Search ..... 400/207, 208, 208.1, 400/236

[56] References Cited

U.S. PATENT DOCUMENTS

| | | | |
|---|---|---|---|
| 3,260,344 | 7/1966 | Doyle . | |
| 3,692,255 | 9/1972 | Von Behren | 242/192 |
| 4,134,693 | 1/1979 | Crickmore et al. | 400/208 |
| 4,213,715 | 7/1980 | Haftmann et al. | 400/196.1 |
| 4,367,963 | 1/1983 | Daughters | 400/208 |
| 4,397,574 | 8/1983 | Wojdyla | 400/196.1 |
| 4,496,255 | 1/1985 | Meintrup et al. | 400/208 |
| 4,528,572 | 7/1985 | Sasaki et al. | 346/76 PH |
| 4,568,210 | 2/1986 | Privitera | 400/235.1 |
| 4,629,346 | 12/1986 | Surti | 400/208 |
| 4,685,817 | 8/1987 | Surti | 400/208 |
| 4,720,202 | 1/1988 | Kawakami | 400/208 |

FOREIGN PATENT DOCUMENTS

| | | | |
|---|---|---|---|
| 3536402 | 4/1986 | Fed. Rep. of Germany | 400/208 |
| 31990 | 2/1985 | Japan | 400/208 |

OTHER PUBLICATIONS

IBM Technical Disclosure Bulletin entitled, "Improved Capacity Typewriter Ribbon", vol. 22, No. 8A, Jan. 1980, at p. 3469.

*Primary Examiner*—Charles Pearson

*Attorney, Agent, or Firm*—John A. Brady

[57] ABSTRACT

A symmetrical printer ribbon cartridge which is refillable. An internal, continuous drive belt (15) provides tension to push studs (33, 35) of the supply spool (23) and of a take-up spool (29) to the ends of notches (31, 32) in cartridge wall 1. When the original supply spool is emptied, a new spool need only be moved into place and the free end of the ribbon pulled from the new spool, directed through the ribbon path in the cartridge, and attached to the remaining spool.

6 Claims, 1 Drawing Sheet

RELOADABLE RIBBON CARTRIDGE

TECHNICAL FIELD

This invention relates to printer ribbon cartridges. Such cartridges house a transfer medium or ribbon and facilitate installation of the ribbon. Typically, the cartridge contains elements which mechanically participate in ribbon feed which is primarily done by the printer on which the cartridge is installed.

BACKGROUND ART

The primary novelty of this invention is considered to be in its provisions for installing a new ribbon in the cartridge. The following references show such refillable cartridges, but are not otherwise notably similar to the embodiment of this invention. These references are the following: U.S. Pat. Nos. 3,260,344 to Doyle, 4,213,715 to Haftmann et al, 4,367,963 to Daughters, and 4,397,574 to Wojdyla.

The embodiment of this invention includes an endless belt ribbon feed. Comparable belt drives are shown in the following references none of which show refillable cartridges: U.S. Pat. Nos. 3,692,255 to Von Behren, 4,528,572 to Sasaki et al, and 4,629,346 to Surti and 4,685,817 to Surti. Since these cartridges are not refillable, they normally are discarded entirely when their ribbon has been used. This invention provides for the reuse of cartridges and thereby saves the costs of providing additional cartridges.

The preferred embodiment of this invention is symmetrical so that the cartridge can be turned over and the ribbon driven back the other way. This permits reuse of the cartridge parts with a double width ribbon and thereby provides a cost saving. Such reversibility is considered essentially conventional in this art. Illustrative of such reversibility and the general cartridge configuration of the preferred embodiment are the following: U.S. Pat. Nos. 4,496,255 to Meintrup et al, and 4,568,210 to Privitera and *IBM Technical Disclosure Bulletin* article entitled "Improved Capacity Typewriter Ribbon," Vol. 22, No. 8A, Jan. 1980 at P. 3469.

SUMMARY OF THE INVENTION

In accordance with this invention a ribbon cartridge has an internal, continuous drive belt and the top and bottom walls of the cartridge housing have notches or slots for receiving pivot studs of a supply spool hub and of a take-up spool hub. The notches have ends positioned so that the tension of the drive belt pushes the studs of installed hubs into the ends of the notches. The cartridge may have widely spaced guide arms for positioning the ribbon across a sheet of paper.

This refillable cartridge is potentially inexpensive and effective. The used hub is relatively large and easily handled for removal. With the used hub removed, the spool of new ribbon need only be moved into the place of the removed hub. The outer end of the ribbon then is pulled from the new spool and directed through the arms and to the remaining hub, which will then serve as the take-up spool hub L-shaped.

BRIEF DESCRIPTION OF THE DRAWING

This invention is described in detail below with reference to the accompanying drawing, in which.

BEST MODE FOR CARRYING OUT THE INVENTION

Figure 1:
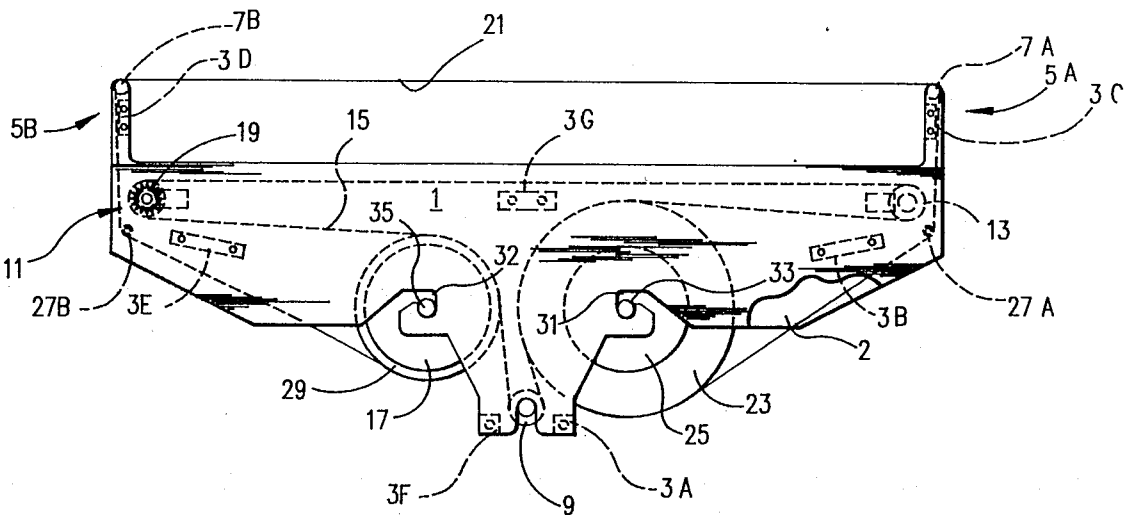
FIG. 1 is a top view of the cartridge.

The cartridge is entirely symmetrical as it is to be turned over to permit driving of the ribbon in both directions. Accordingly, the FIG. 1 view is equally descriptive of the side of the ribbon opposite that shown in FIG. 1. The cartridge comprises an outer wall 1 of thin plastic, such as polyethylene or polypropylene, separated from an opposite wall 2 which is essentially identical to wall 1 by supporting posts 3A, 3B, 3C, 3D, 3E, 3F, and 3G. Posts 3A through 3G are the same length (about 16 mm in this embodiment) and are positioned at seven locations around the outer edges of the cartridge to provide a stable separation of wall 1 from its opposite, essentially identical wall 2.

The wall 1 has extending arms 5A and 5B on opposite sides, which each have one post 3C and 3D respectively and also have one smooth, outer post 7A and 7B respectively at their end. Posts 7A and 7B are the same length as posts 3A through 3G and posts 7A and 7B do not necessarily serve as supports. Posts 7A and 7B are primarily intended to function as ribbon guides. Rollers can be used on posts 7A and 7B to minimize frictional drag on the ribbon.

Mounted between wall 1 and its opposite wall are three rollers 9, 11, and 13. Roller 9 is centered in wall 1 on the opposite side from arms 5A and 5B and has two supporting posts 3A and 3F near it on opposite sides of it. Post 3G is centered in wall 1 and located across from roller 9 near the side of the cartridge. Roller 9 is an idler roller for a drive belt 15, and, as such, is mounted to turn freely. Rollers 11 and 13 are on opposing sides of wall 1 near the beginning of arms 5B and 5A respectively. Each has a support post 3E and 3B near it with roller 11 being between arm 5B and post 3E and roller 13 being between arm 5A and post 3B.

The view of FIG. 1 is a top view with respect to the cartridge when it is mounted on a printer. In the configuration shown roller 13, nearest the supply hub 25, will connect with a drive gear of a printer on which it is mounted. Teeth for interconnection with a gear on a printer are facing downward in FIG. 1 and therefore do not appear for roller 13 in FIG. 1. Roller 11 is dimensionally identical with roller 13, and teeth 19, essentially identical teeth to those on roll 13, appear facing upward in FIG. 1.

Supply spool 23 is formed by printer ribbon 21 being rolled on supply spool hub 25. Ribbon 21 is directed to inner guide posts 27A and 27B located generally behind arms 5A and 5B respectively. Ribbon 21 extends from supply spool 23 to post 27A, then around post 7A on the end of arm 5A, across the cartridge, around the post 7B on arm 5B at the other side of the cartridge, to the post 27B near arm 5B, and then to take-up spool 29 of ribbon 21 rolled on take-up spool hub 17. (Rollers may be mounted on posts 27A and 27B to reduce frictional drag on the ribbon).

Drive belt 15 is of an elastic material, such as polyurethane, and is stretched by contact with ribbon spools 23 and 29. Belt 15 is therefore in firm engagement with spools 23 and 29, which negates slippage during ribbon feed by the rotation of roller 13 from a printer. Wall 1 has L-shaped slots or notches 31 and 32, which have bent paths ending at locations generally in the path of the direction of the forces of belt 15 on spools 23 and 29.

Stud 33, which is integral with supply spool hub 23, fits in the notch 31 nearest roller 13 (this arrangement of a stud 33 and notch 31 being identical on the opposite wall 2). Similarly, stud 35 integral with take-up spool hub 17, fits in the notch 32 nearest roller 11 (this arrangement of a stud 35 and notch 32 being identical on the opposite wall 2). The stretched belt 15, being generally opposite the end of notch 31, forces the stud 33 of supply spool hub 25 in notch 31 and holds it against the end of that notch 31. Similarly, belt 15 forces the stud 35 of take-up spool hub 17 in the other notch 32 and holds it against the end of that notch 32.

Figure 2:
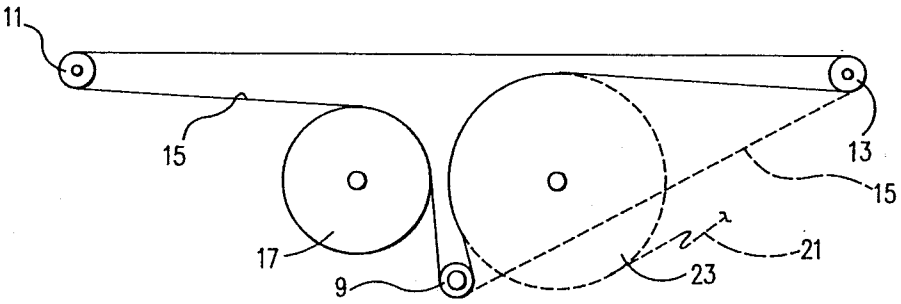
FIG. 2 is a top view of just the drive belt and ribbon elements of the cartridge.

For illustrative purposes FIG. 2 shows only elements directly associated with the drive belt 15 and with ribbon 21. Drive belt 15 with the supply spool removed is shown in dotted outline.

In use the cartridge is installed on a printer (not shown) which is designed to use the cartridge, and the printer drives roller 13 clockwise with respect to drawing. This provides drive force through belt 15 first to roller 11, then to take-up spool 29 and then over roller 9 to supply spool 23, which operates to assure take-up is at least equal to feed. After printing sufficiently supply spool 23 will be reduced in size to almost empty of ribbon 21 and take-up spool 29 will be large, as distinguished from the almost opposite condition shown in FIG. 1. In a specific embodiment, actual printing may be on one side, for example, the lower half, of ribbon 21. The cartridge is then manually removed, turned over bodily, and replaced in the printer. The cartridge will then appear virtually identical to that shown in FIG. 1, while roller 13 will be on the left and roller 11 will be on the right, and the supply spool 23 and the take-up spool 29 will be reversed. In subsequent use, roller 11 will function as the drive roller as discussed above with regard to roller 13, and hub 17 will function as the supply spool hub and hub 25 will function as the take-up spool hub.

Referring again to FIG. 1, at some point all of the ribbon 21 will be used or depleted and almost all of ribbon 21 will be on the spool acting as the take-up spool, spool 29 in FIG. 1. The end of ribbon 21 is then pulled from supply spool hub 25, to which it is lightly attached by adhesive, and the full take-up spool hub 17 with ribbon 21 is discarded. Hub 25 is left in place. A new hub 17 having a full spool of unused ribbon 21 is positioned at the empty notch 32 and stud 35 is guided through notch 32 until belt 15 forces it into the end of notch 32. At this point belt 15 is again stretched and therefore holds the new spool of ribbon 21 in place, as well as hub 25 in the manner described above. The free end of ribbon 21, which typically is an uninked leader, is manually guided in the previous ribbon path and attached to hub 25, as by a pressure sensitive adhesive provided on the leader of ribbon 21. This completes installation of the new ribbon 21. The cartridge is turned over and installed on the printer for use. (Of course, the cartridge may be turned over prior to installing the new ribbon, in which event the position of the hubs and notches is simply opposite to that discussed.)

It will be clear that this invention can be practiced essentially as described with a narrow ribbon which allows printing in only one direction. In that event the ribbon would be replaced after a single pass, and it would not be important that the cartridge be symmetrical. Other modification within the spirit and scope of this invention will be apparent.

Accordingly, patent coverage should not be restricted by the details of the embodiment shown, but should be as provided by law, with particular reference to the accompanying claims.

What is claimed is:

1. A ribbon cartridge comprising an outer wall; a printer ribbon contained by said cartridge;

said cartridge having a pair of guide arms extending from a front side of the cartridge an internal, continuous belt located to engage the outside of a first spool of said ribbon and to engage the outside of a second spool of said ribbon to drive said ribbon by friction contact at the locations of said engagement with said first spool and said engagement with said second spool; notches in said wall of said cartridge to removably receive pivot studs for a hub of said first spool and for a hub of said second spool, said notches being located on a back side of said cartridge, opposite said front side, said belt being located to push said studs of said hubs into said notches when said first spool and said second spool are installed to position said spools for rotation for feeding said ribbon from one of said spools to the other of said spools, said notches having generally L-shaped bent paths ending at locations generally in the path of the direction of forces of said belt on said spools, said studs being pressed against the ends of the bent paths by said belt, the belt tending to urge said spools in a direction pointed away from said front side of said cartridge.

2. The cartridge as in claim 1 in which said wall comprises substantially identical, generally flat opposing surfaces.

3. The cartridge as in claim 2 wherein said cartridge is symmetrical for permitting said cartridge to be installed on one side for use on a printer and then to be turned over and installed on the opposite side for use on a printer for feeding said ribbon in opposite directions.

4. The cartridge as in claim 1 wherein said cartridge is symmetrical for permitting said cartridge to be installed on one side for use on a printer then to be turned over and installed on the opposite side for use on a printer for feeding said ribbon in opposite directions.

5. A ribbon cartridge comprising a first wall and a second wall separated by support means, a printer ribbon contained in said cartridge;

said cartridge having a pair of guide arms extending from a front side of the cartridge a continuous belt contained in said cartridge located to engage the outside of a first spool of said ribbon and to engage the outside of a second spool of said ribbon to drive said ribbon by friction contact at the locations of said engagement with said first spool and said engagement with said second spool, said first spool being wound on a first hub and said second spool being wound on a second hub, said hubs each having studs integral with said hubs for winding said spools by pivoting on said hubs, first notches in said walls to removably receive the studs of said first spool and second notches in said walls to removably receive the studs of said second spool, said notches being located on a back side of said cartridge, opposite said front side, said belt being located to push said studs of said hubs into said notches when said first spool and said second spool are installed to position said spools for rotation for feeding said ribbon from one of said spools to the other of said spools, said notches having generally L-shaped bent paths ending at locations generally in the path of the direction of forces of said belt on said spools said studs being pressed against the ends of the bent paths by said belt, the belt tending to urge said spools in a direction pointed away from said front side of said cartridge.

6. The cartridge as in claim 5 wherein said cartridge is symmetrical for permitting said cartridge to be installed on one side for use on a printer and then to be turned over and installed on the opposite side for use on a printer for feeding said ribbon in opposite directions.

* * * * *